US007017342B2

(12) United States Patent
Iimura et al.

(10) Patent No.: US 7,017,342 B2
(45) Date of Patent: Mar. 28, 2006

(54) AIR COMPRESSOR AND CONTROL METHOD THEREFOR

(75) Inventors: Yoshio Iimura, Ibaraki (JP); Hiroaki Orikasa, Ibaraki (JP); Mitsuhiro Sunaoshi, Ibaraki (JP); Kazuhiro Segawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 21 days.

(21) Appl. No.: 10/901,123

(22) Filed: Jul. 29, 2004

(65) Prior Publication Data

US 2005/0053483 A1 Mar. 10, 2005

(30) Foreign Application Priority Data

Sep. 10, 2003 (JP) ..... P2003-317880

(51) Int. Cl.
*F16D 31/02* (2006.01)

(52) U.S. Cl. ..... 60/410; 60/329; 60/418

(58) Field of Classification Search ..... 60/328, 60/329, 409, 410, 418
See application file for complete search history.

(56) References Cited

U.S. PATENT DOCUMENTS 4,060,987 A * 12/1977 Fisch et al. ..... 60/409
4,756,669 A * 7/1988 Hata ..... 60/418
5,438,829 A * 8/1995 Kubota et al. ..... 60/410
5,632,146 A * 5/1997 Foss et al. ..... 60/410
6,197,787 B1 * 3/2001 Franson et al. ..... 514/313
6,519,938 B1 * 2/2003 Foss ..... 60/410
6,779,989 B1 * 8/2004 Makino et al. ..... 417/410.1
6,860,103 B1 * 3/2005 Raghvachari ..... 60/410

FOREIGN PATENT DOCUMENTS

| | | |
|---|---|---|
| JP | 4-296505 | 10/1992 |
| JP | 6-63505 | 8/1994 |
| JP | 11-280653 | 10/1999 |
| JP | 2002-228233 | 8/2002 |

* cited by examiner

*Primary Examiner*—Edward K. Look
*Assistant Examiner*—Michael Leslie
(74) *Attorney, Agent, or Firm*—McGinn IP Law Group, PLLC

(57) ABSTRACT

An air compressor includes a tank unit storing a compressed air used by a pneumatic tool, a compressed air generator which generates the compressed air and supplies the compressed air to the tank unit, a motor driving the compressed air generator, a drive portion including the motor, a controller portion controlling the drive portion and a pressure sensor detecting an air pressure of the compressed air in the tank unit, in which the controller portion controls a rotation speed of the motor at multiple levels based on a detection signal P1 of the pressure sensor, a first differential signal which is a differential value d(P1)/dt of the detection signal P1, and a second differential signal which is a differential value d(P2)/dt of a detection signal P2 obtained by removing a pulsatory element from the detection signal P1.

10 Claims, 9 Drawing Sheets

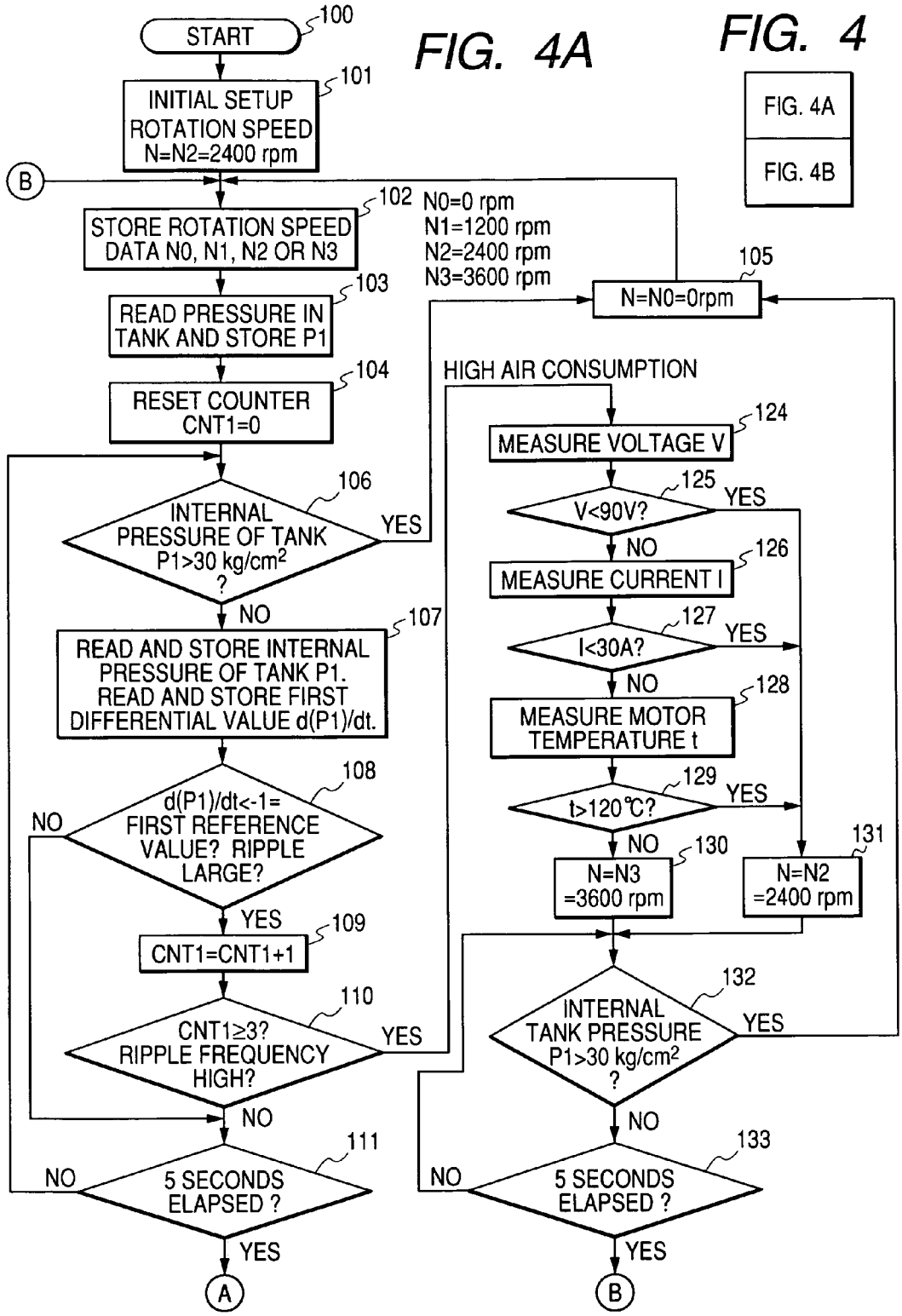
FIG. 4A
FIG. 4
FIG. 4A
FIG. 4B
START
100
INITIAL SETUP ROTATION SPEED N=N2=2400 rpm
101
B
STORE ROTATION SPEED DATA N0, N1, N2 OR N3
102
N0=0 rpm
N1=1200 rpm
N2=2400 rpm
N3=3600 rpm
READ PRESSURE IN TANK AND STORE P1
103
RESET COUNTER CNT1=0
104
INTERNAL PRESSURE OF TANK P1>30 kg/cm2 ?
106
YES
NO
READ AND STORE INTERNAL PRESSURE OF TANK P1. READ AND STORE FIRST DIFFERENTIAL VALUE d(P1)/dt.
107
d(P1)/dt<-1= FIRST REFERENCE VALUE? RIPPLE LARGE?
108
NO
YES
CNT1=CNT1+1
109
CNT1≥3? RIPPLE FREQUENCY HIGH?
110
YES
NO
5 SECONDS ELAPSED ?
111
NO
YES
A
N=N0=0rpm
105
HIGH AIR CONSUMPTION
MEASURE VOLTAGE V
124
V<90V?
125
YES
NO
MEASURE CURRENT I
126
I<30A?
127
YES
NO
MEASURE MOTOR TEMPERATURE t
128
t>120℃?
129
YES
NO
N=N3 =3600 rpm
130
N=N2 =2400 rpm
131
INTERNAL TANK PRESSURE P1>30 kg/cm2 ?
132
YES
NO
5 SECONDS ELAPSED ?
133
NO
YES
B ROTATION SPEED SHIFT DETERMINATION TABLE N1(=1200 rpm)

ROTATION SPEED SHIFT DETERMINATION TABLE N0(=0 rpm)

AIR COMPRESSOR AND CONTROL METHOD THEREFOR

BACKGROUND OF THE INVENTION

1. Field of the Invention

The present invention relates to an air compressor for compressing air to be used by a pneumatic tool such as a pneumatic nailer and a method for controlling the same.

2. Description of the Related Art

An air compressor applied for the operation of pneumatic tools is generally designed so that as a motor rotates a crankshaft in the main body of the air compressor, a piston served by the crankshaft reciprocates within a cylinder according to the rotation speed of the crankshaft and compresses air supplied via an intake valve. Thereafter, the compressed air is discharged from the main body of the air compressor, through an air release valve and a pipe, to an air tank for storage. The compressed air stored in this tank can then be applied for the operation of pneumatic tools used for nailing.

Since air compressors are frequently employed outdoors, such as at construction sites or in locations whereat houses are constructed close together, the present inventors, based on various perspectives, determined that improvements were advisable. Thus, we performed research to evaluate the performance of air compressors under actual prevailing encountered in various situations, and as a result, to delineate the user requests and technical problems we encountered during our research, we decided to use the following categories.

(1) Noise Reduction

Since an air compressor includes a mechanism for converting the rotation of a motor into the reciprocal movement of a piston in a cylinder, the generation of considerable noise can not be avoided. Further, since a nailer that uses air compressed by an air compressor also generates noise while in operation, there is considerable noise pollution, and physical discomfort, in an area surrounding a construction site whereat both air compressors and pneumatic nailers are being employed. Thus, when such equipment is to be used early in the morning or late in the evening at locations whereat houses are constructed close together, the request for maximum noise reduction is expressed especially strong.

(2) Increased Power and Efficiency

Locations whereat air compressors are employed are not always in satisfactory power supply environments; on the contrary, air compressors are frequency used in environments wherein sufficiently high voltages can not be obtained because long cords, stretched from other locations, are employed to supply power, or in environments wherein a large volume of the compressed air is used because multiple tools are in use at the same time.

Therefore, occasionally, high power cannot be output by an air compressor, and when, for example, nailers are employed while the power output is insufficient, a so-called shallow nail holding phenomenon can occur and nails can not be set well in the material being processed.

Usually, air is stored in the air compressor air tank at a pressure of from 26 to 30 kg/cm$^2$, and during a period wherein no tools are being employed, air leakage can not be avoided. Thus, dependant on the air usage, a reduction in efficiency occurs.

(3) Improvement in Size Reduction and Portability

While some of the air compressors are used for pneumatic tools are of a stationary type, most air compressors are portable, and can be carried to and employed at construction sites. Therefore, a need has been expressed for minimum sized air compressors for which the portability is excellent. Thus, for compressed air generators, and drive portions therefor, complicated structures should be avoided, and to the extent possible, deterioration of portability should be prevented.

(4) Extension of Service Life

The service life of air compressors for supporting pneumatic tools is shorter than the service life of compressors used for refrigerators and air conditioners. This is understandable, when the severe environmental conditions under which air compressors are used are taken into account. However, longer service life is still demanded that can be attained by restricting, to the extent possible, load fluctuation, or by preventing the unnecessary compression of air.

(5) Suppression of Temperature Rise

Due to the reciprocal movement of a piston in a cylinder and the current flowing to a motor that indirectly drives the piston, an increase in the temperature within an air compressor is unavoidable. However, as the temperature in the air compressor is increased, loss is also increased, and the attainment of high efficiency is prevented. Therefore, a strong demand also exists for the suppression, as quickly as possible, of a rise in the temperature within an air compressor.

In JP-A-2002-228233, a technique is disclosed whereby an uncomfortable sensation is reduced by suppressing a difference in the noise that is generated during the continuous operation of an indoor fan motor for an air conditioner.

In JP-B-6-63505, an air compressor is disclosed wherein, in accordance with a pressure change state wherein, because of a reduction in the pressure in a tank, the air compressor begins a loaded operation, the operating mode in the standby state, following the increase in the pressure, is changed to a intermittent operating mode or a continuous operating mode.

SUMMARY OF THE INVENTION

The present invention is provided to furnish solutions especially noise reduction and increased power and efficiency.

An object of the present invention is to provide an air compressor that is rotated at low speed, thereby reducing the noise produced, when only a small amount of air is required to operate the pneumatic tool, and that is immediately shifted to fast rotation, to prevent the occurrence of a shortage of power, when a considerable amount of air is required, within a short period of time, to continuously drive, for example, concrete nails or large diameter wood nails.

To achieve this objective, according to a first aspect of the present invention, an air compressor includes a tank unit storing a compressed air used by a pneumatic tool, a compressed air generator which generates the compressed air and supplies the compressed air to the tank unit, a motor driving the compressed air generator, a drive portion including the motor, a controller portion controlling the drive portion and a pressure sensor detecting an air pressure of the compressed air in the tank unit, characterized in that the controller portion controls a rotation speed of the motor at multiple levels based on a detection signal P1 of the pressure sensor, a first differential signal which is a differential value d(P1)/dt of the detection signal P1, and a second differential signal which is a differential value d(P2)/dt of a detection signal P2 obtained by removing a pulsatory element from the detection signal P1.

According to a second aspect of the invention, the controller portion controls a rotation speed of the motor at multiple levels based on a detection signal P1 of the pressure sensor, a first differential signal which is a differential value d(P1)/dt of the detection signal P1, and a second differential signal obtained by supplying the first differential signal to a low-pass filter.

According to a third aspect of the invention, the air compressor further includes a temperature sensor detecting a temperature of the motor, characterized in that the controller portion controls the rotation speed of the motor at multiple levels in accordance with a detection signal of the temperature sensor, the detection signal P1 of the pressure sensor and the first and the second differential signals.

According to a fourth aspect of the invention, the air compressor further includes a sensor detecting a power voltage and a load current of the drive portion, characterized in that the controller portion controls the rotation speed of the motor in accordance with a detection signal of the sensor which detects the power voltage and the load current of the drive portion, the detection signal P1 of the pressure sensor and the first and the second differential signals.

The air compressor of the invention prepares multiple levels for the rotation speed of a motor, and controls the rotation speed based on two differential values: the differential value output by the pressure sensor of the pressure tank and the differential value of a signal obtained by removing a ripple from the output of the pressure sensor. Therefore, when the air compressor is in the standby state and the only air consumption is the result of natural air leakage, or when only a small amount of air is required because a tool such as a small air tacker is being used, the motor can be rotated at a lower speed and the noise can be reduced.

When it is predicted that a large amount of air is consumed in a short period of time, e.g., that continuous driving of nails is performed using a large nailer, the rotation speed of the motor is shifted immediately to the high speed, and a reduction in the pressure in the air tank can be suppressed. Therefore, for the continuous driving of nails having a large diameter for concrete or wood, the frequency at which the shallow nail holding phenomenon occurs can be reduced. Further, even when there is a temporary occurrence of this phenomenon, the period affected is extremely shortened.

In addition, when a large ripple in the pressure in the air tank and a high occurrence frequency are detected, and when the motor is shifted to the high rotation speed, the previous rotation speed is maintained at least for a predetermined period (e.g., five seconds). Therefore, frequent switching of the rotation speed of the motor within a short period of time can be avoided, and provision of an uncomfortable sensation can be suppressed.

DETAILED DESCRIPTION OF THE PREFFERED EMBODIMENTS

The preferred embodiment of the present invention will now be described in detail.

As is shown in a conceptual diagram in FIG. 1, an air compressor according to the invention includes a tank unit 10, for storing compressed air; a compressed air generator 20, for generating compressed air; a drive portion 30, for driving the compressed air generator 20; and a controller portion 40, for controlling the drive portion 30.

(1) Tank Unit 10

Figure 2:
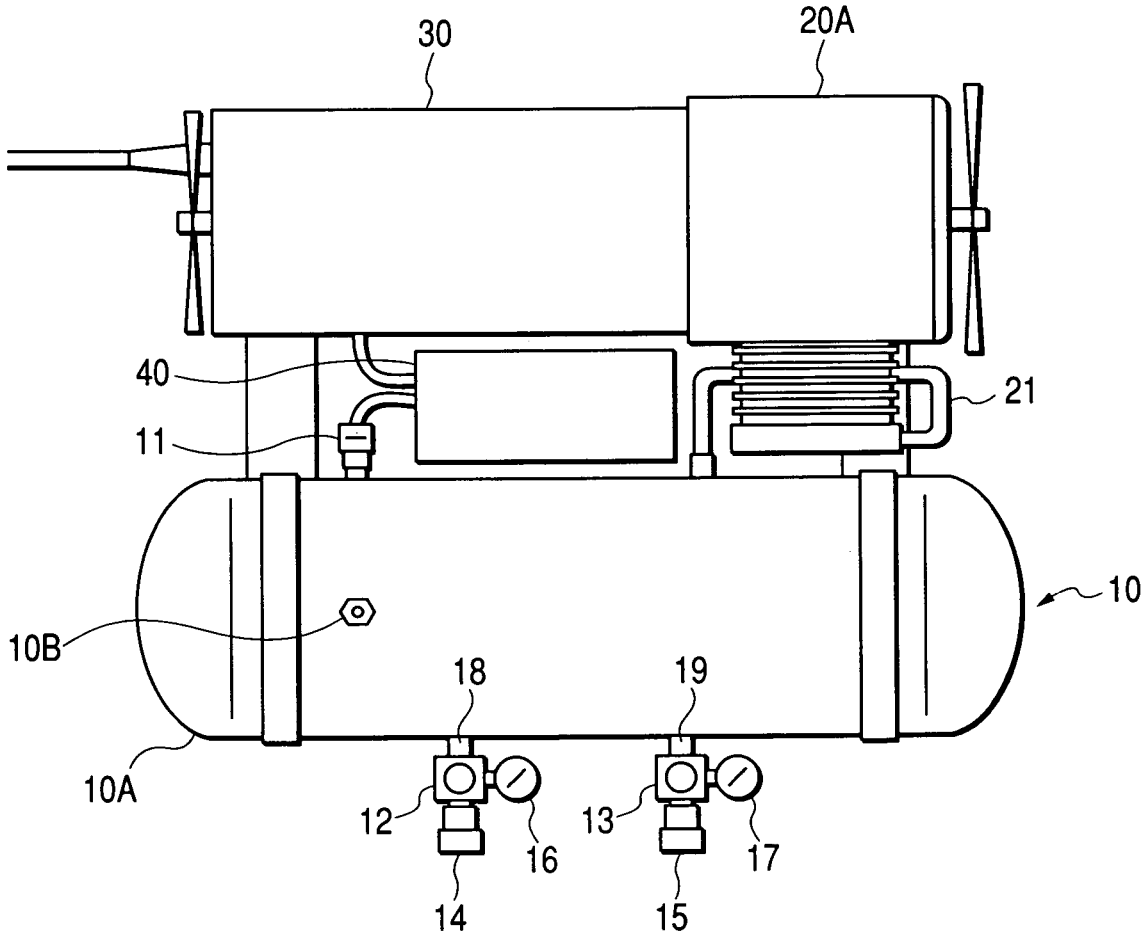
FIG. 2 is a top view of the air compressor according to the embodiment of the invention.

As is shown in FIG. 2, the tank unit 10 includes an air tank 10A, for storing compressed air, to which high-pressure, 20 to 30 kg/cm$^2$ compressed air is supplied through a pipe 21 connected to the discharge port of a compressor 20A.

Generally, a plurality of compressed output ports 18 and 19 are provided for the air tank 10A, and in this embodiment, the feed pipe 18 is used to feed low-pressure compressed air and the feed pipe 19 is used to feed high-pressure compressed air. The present invention, however, is not limited to this example.

The low-pressure compressed output port 18 is connected through a pressure reducing valve 12 to a low pressure coupler 14. For the pressure reducing valve 12, the maximum pressure for the compressed air is determined on the output side, regardless of the air pressure on the input side. In this embodiment, the designated maximum pressure is a predetermined value ranging from 7 to 10 kg/cm$^2$. Therefore, regardless of the air pressure in the air tank 10A, the air pressure for the compressed air obtained at the output side of the pressure reducing valve 12 is equal to or lower than the maximum pressure.

The compressed air output at the pressure reducing valve 12 is supplied, through the low pressure coupler 14, to a low pressure pneumatic tool 51 shown in FIG. 1.

The high-pressure compressed output port 19 is connected through a pressure reducing valve 13 to a high pressure coupler 15. For the pressure reducing valve 13, the maximum pressure for the compressed air is determined on the output side, regardless of the air pressure on the input side. In this embodiment, the designated maximum pressure is a predetermined value ranging of 10 to 30 kg/cm$^2$. Therefore, the air pressure for the compressed air obtained at the output side of the pressure reducing valve 13 is equal to or lower than the maximum pressure. The compressed air output at the pressure reducing valve 13 is supplied, through the high pressure coupler 15, to a high pressure pneumatic tool 52 shown in FIG. 1.

A low pressure gauge 16 and a high pressure gauge 17 are respectively attached to the pressure reducing valves 12 and 13 for monitoring the pressure of the compressed air at the output sides of the pressure reducing valves 12 and 13. In this embodiment, the low pressure coupler 14 and the high pressure coupler 15 vary in size and are not compatible, so as to prevent the high pressure pneumatic tool 52 from being connected to the low pressure coupler 14 and the low pressure pneumatic tool 51 from being connected to the high pressure coupler 15. This configuration was previously disclosed in JP-A-4-296505, submitted by the inventor of the present invention.

Attached to the air tank 10A, to detect the pressure of the compressed air stored therein, is a pressure sensor 11 that transmits to the controller portion 40 a detection signal that is used to control a motor, which will be described later. Further, attached to a part of the air tank 10A is a safety valve 10B that, to ensure a safe operation, releases the part of stored air when an abnormal air pressure within the air tank 10A is detected.

(2) Compressed Air Generator 20

The compressed air generator 20 is a well known one. In the compressed air generator 20, to supply compressed air, a piston, reciprocating within a cylinder, compresses air that enters the cylinder through an air intake valve. Disclosed in JP-A-11-280653, is a mechanism that uses a pinion, provided at the distal end of a rotor shaft, and a gear that engages the pinion, to convert the rotation of a motor into the rotation of an output shaft that serves the reciprocating piston.

As the piston reciprocates in the cylinder, air is sucked in through the intake valve located in the cylinder head and compressed. When a predetermined pressure is reached, the compressed air is released through an air outlet valve provided in the cylinder head and is supplied to the air tank 10A through the pipe 21 in FIG. 2.

(3) Drive Portion 30

Figure 3:
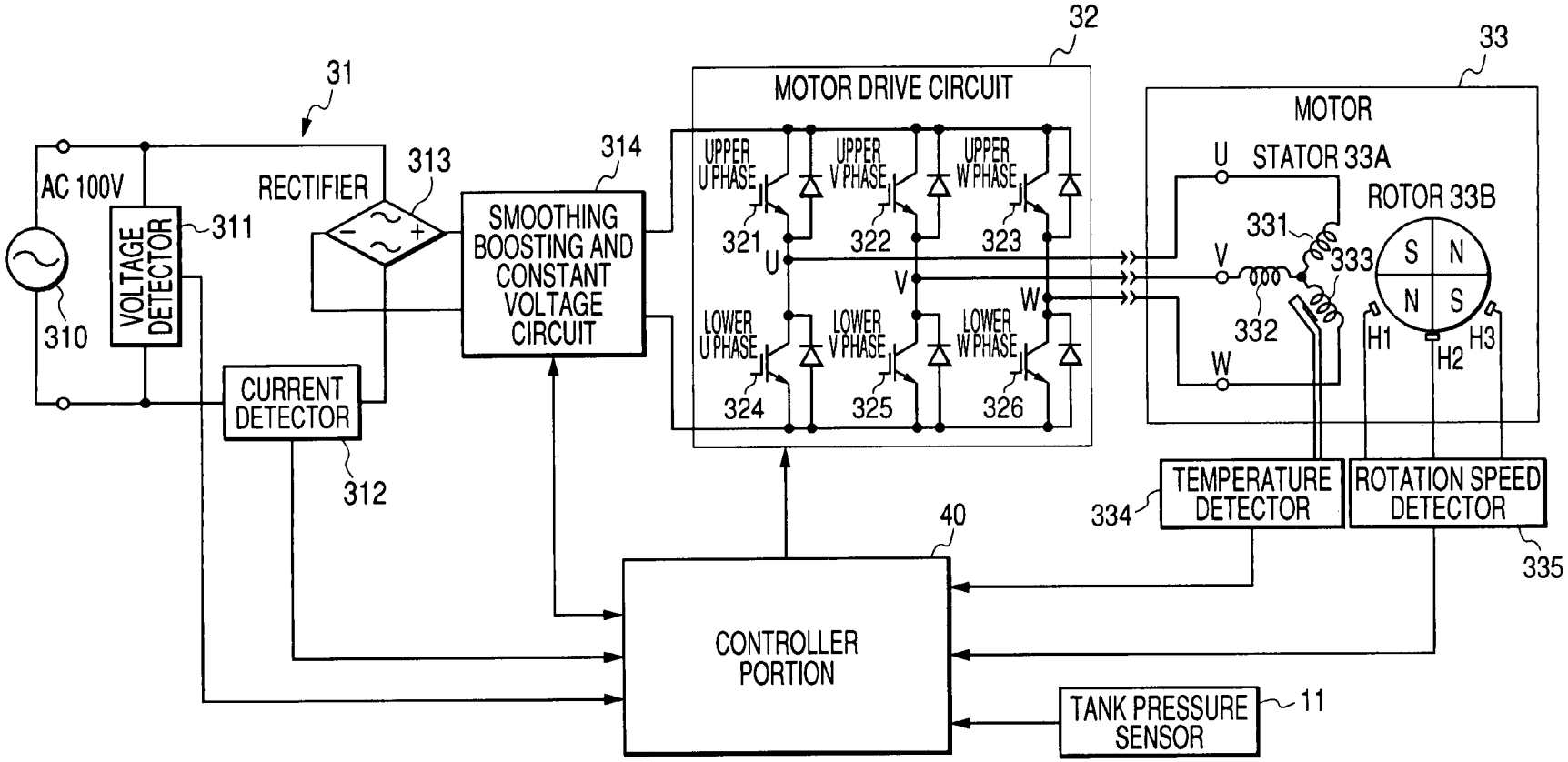
FIG. 3 is a circuit diagram showing the motor drive portion of the air compressor according to the embodiment of the invention.

The drive portion 30 generates a driving force for the reciprocation of the piston, and includes for this purpose, as is shown in FIG. 3, a motor 33, a motor drive circuit 32 and a power supply circuit 31. The power supply circuit 31 includes a rectifier 313, for rectifying the voltage of a 100 Valternating-current power source 310, and a smoothing, boosting and constant voltage circuit 314, for smoothing and boosting the rectified voltage to obtain a constant voltage.

Furthermore, the power supply circuit 31 includes a voltage detector 311 for detecting voltages at both ends of the power source 310, and a current detector 312 for detecting a load current. Signals output by the detectors 311 and 312 are transmitted to the controller portion 40, which will be described later. The detectors 311 and 312 are used to control the motor 33 at a super-high speed rotation within an extremely short period in a range wherein the breaker switch (not shown) of the power source 310 is not opened. Although the controller portion 40 is related to the acquisition of a constant voltage by the constant voltage circuit 314, since the structure of the constant voltage circuit 314 is well known, no detailed explanation for it will be given.

The motor drive circuit 32 includes switching transistors 321 to 326, for employing a direct-current voltage to generate pulse voltages having three phases, a U phase, a V phase and a W phase. The ON/OFF states of the transistors 321 to 326 are controlled by the controller portion 40, and a rotation speed N of the motor 33 is controlled by adjusting the frequency of a pulse signal transmitted to the transistors 321 to 326.

As an example, the rotation speed N of the motor 33 is set at multiple levels times an integer n of a reference value N, e.g., settings for 0 rpm, 1200 rpm, 2400 rpm and 3600 rpm. The motor 33 is rotated at a rotation speed selected from these levels.

Diodes are connected in parallel to the switching transistors 321 to 326 to prevent their destruction due to a counterelectromotive force generated by a stator 33A of the motor 33.

The motor 33 includes the stator 33A and a rotor 33B. Provided for the stator 33A are Windings 331, 332 and 333, which have a U phase, a V phase and a W phase. A rotating magnetic field is induced when a current is flowing through these windings 331 to 333.

In this embodiment, the rotor 33B is a permanent magnet, and is rotated by the rotating magnetic field that is induced when a current is flowing through the windings 331 to 333 for the stator 33A. A force produced by the rotation of the rotor 33B serves as a driving force for the reciprocation of the piston in the compressed air generator 20 (FIG. 1).

The motor 33 also includes a temperature detector 334 for detecting the temperatures of the windings 331 to 333 for the stator 33A, and outputting detection signals to the controller portion 40. As needed, a rotation speed detector 335 is also provided for the motor 33 to detect the rotation speed of the rotor 33B, and to output detection signals to the controller portion 40.

(4) Controller Portion 40

Figure 1A:
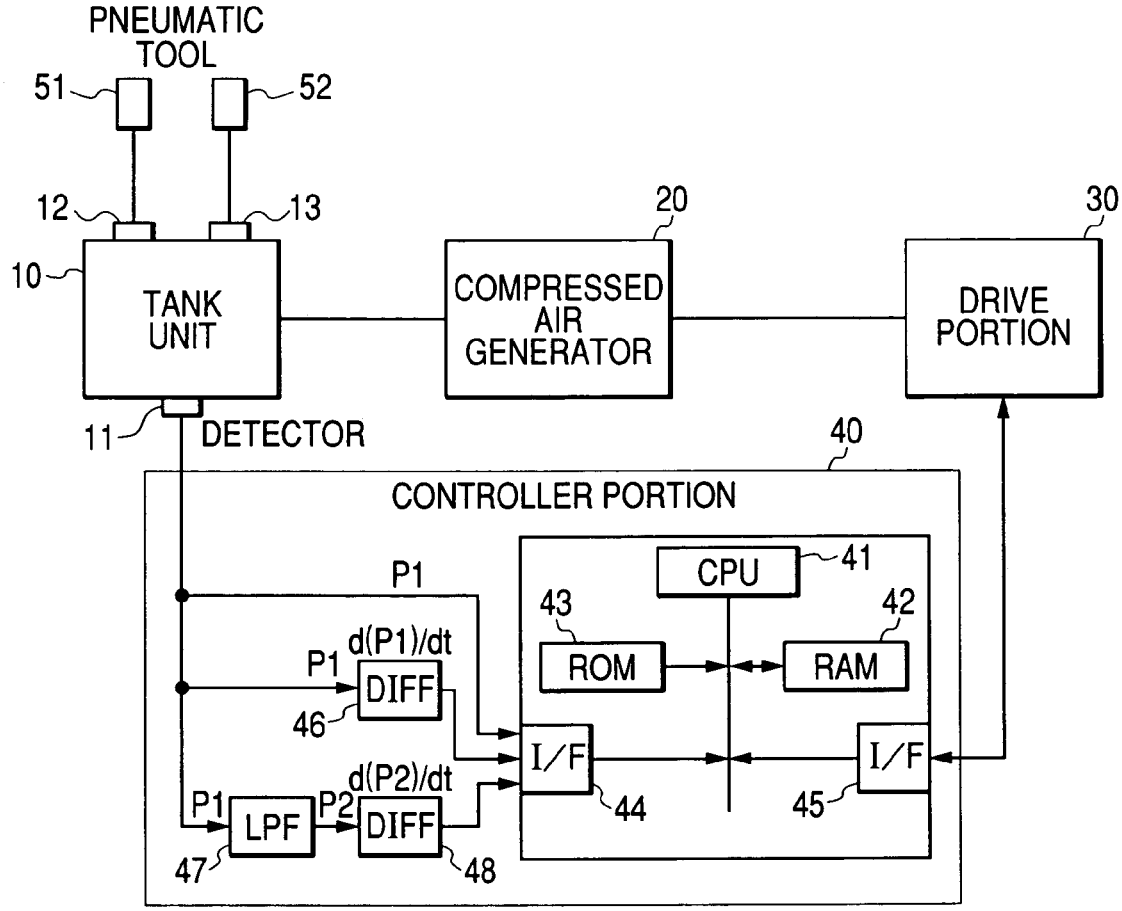
FIG. 1A is a conceptual diagram showing an air compressor according to one embodiment of the present invention.

As is shown in FIG. 1A, the controller portion 40 includes: a central processing unit (hereinafter abbreviated as a CPU) 41, a random access memory (hereafter abbreviated as a RAM) 42, a read only memory (hereinafter abbreviated as a ROM) 43, differentiators 46 and 48, and a low-pass filter 47.

A detection signal P1 output by the pressure sensor 11 and the detection signals for the voltage detector 311, the current detector 312 and the temperature detector 334 are transmitted to the CPU 41 across interface circuits (hereafter abbreviated as I/F circuits) 44 and 45.

In this embodiment, the detection signal P1 for the pressure sensor 11 is transmitted to the differentiator 46 and the low-pass filter 47, and an output P2, by the low-pass filter 47, is transmitted to the differentiator 48. An output d(P1)/dt, for the differentiator 46, and an output d(P2)/dt, for the differentiator 48, are transmitted to the CPU 41 with the detection signal P1.

Figure 1B:
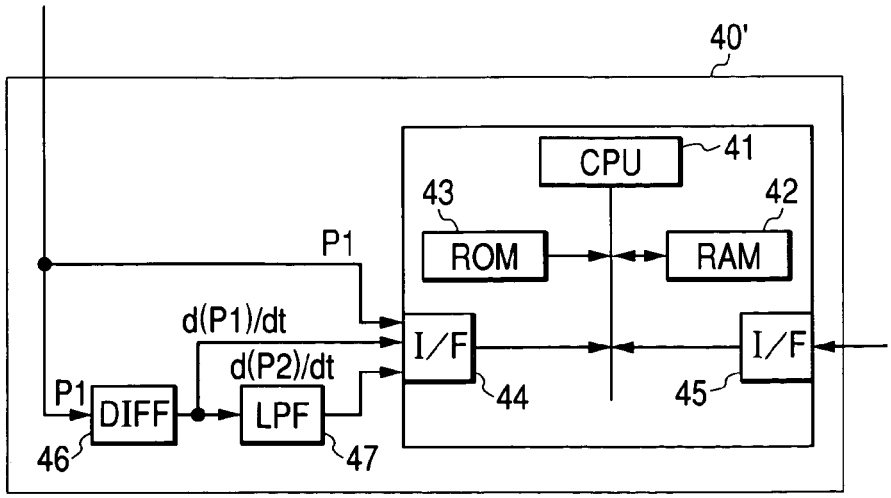
FIG. 1B is a block diagram showing another example for a controller portion shown in FIG. 1A.

Instead of using the differentiator 48, the output of the differentiator 46 may be supplied to the low-pass filter 47, as is shown in FIG. 1B, and the output d(P2)/dt can also be obtained. An instruction signal output by the CPU 41 is transmitted across the I/F circuit 45 to the motor drive circuit 32 for the motor 30 to control the switching transistors 321 to 326 (FIG. 3). A motor control program, shown in FIG. 4, is stored in the ROM 43, and the RAM 42 is employed for the temporary storage of data required for the execution of the programs and the computation results.

[Embodiment]

Figure 4B:
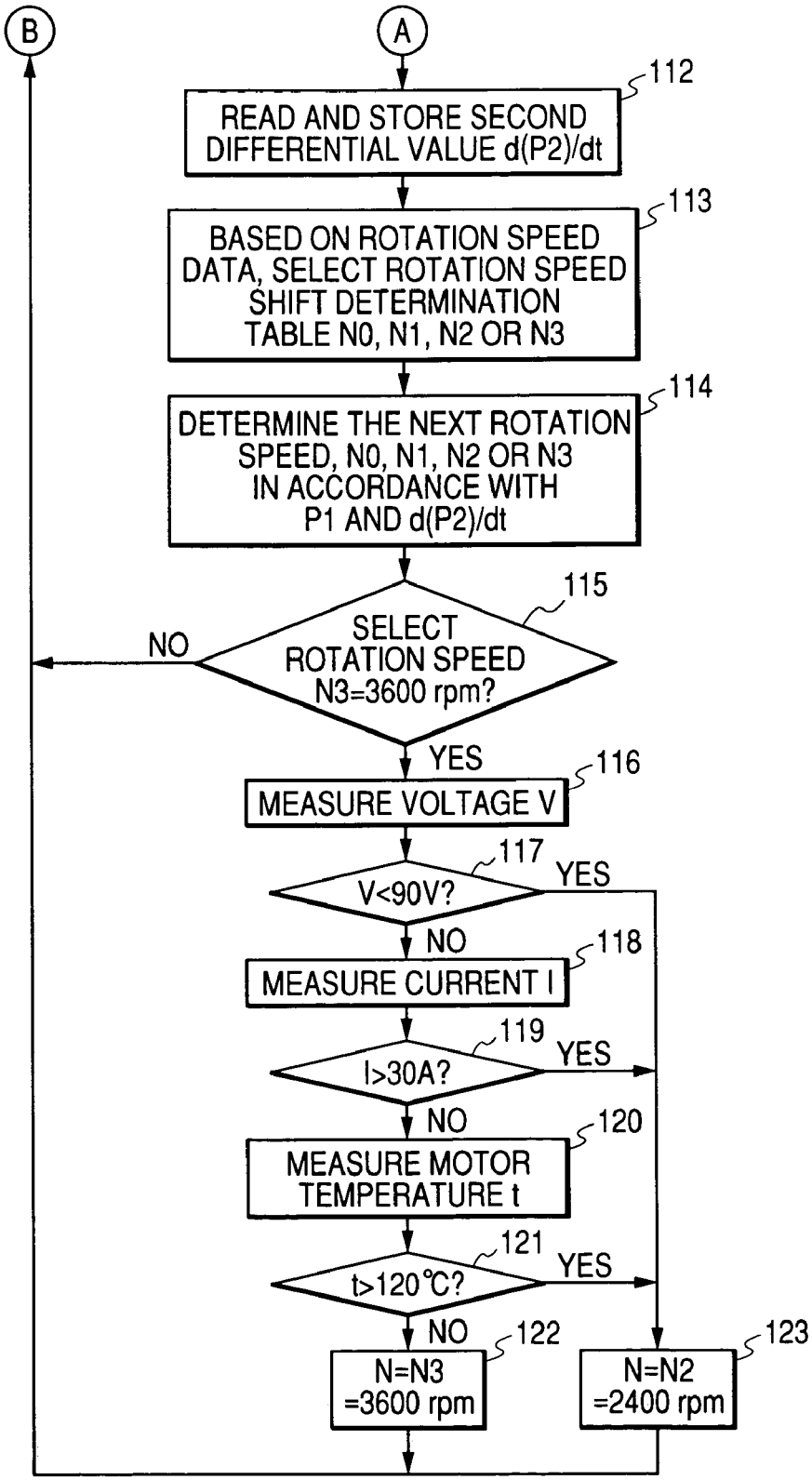
FIG. 4 is a flowchart showing a program used for controlling the air compressor according to the embodiment of the invention.

FIG. 4 is a flowchart for a program stored in the ROM 43 provided for the controller portion 40 according to the embodiment of this invention.

First, an initial setup is performed at step 101, and N2=2400 rpm is set as the rotation speed N for the motor 33. Then, at step 102, data for the rotation speeds employed for controlling the air compressor of the invention is stored. In this embodiment, since the rotation speed N of the motor 33 is controlled to four levels, N0 (=0 rpm), N1 (1200 rpm), N2 (2400 rpm) and N3 (3600 rpm), the values N0, N1, N2 and N3 are stored in appropriate areas in the RAM 42. More levels can be easily provided for the rotation speed of the motor 33, but at least three levels are preferable.

Following this, at step 103, the pressure P1, of the compressed air in the air tank 10A, is measured and stored. At step 104, when a large ripple occurs in the pressure P1, a counter CNT1 for counting the number of ripples is reset to zero. Then, at step 106, a check is performed to determine whether the measured pressure P1 is greater than 30 kg/cm$^2$. When the decision at step 106 is affirmative (YES), program control is shifted to step 105 and the rotation speed N of the motor 33 is set to N0 (0 rpm). That is, in this embodiment, the pressure maintained in the air tank 10A is 26 to 30 kg/cm$^2$, and when the internal tank pressure exceeds 30 kg/cm$^2$, the rotation of the motor 33 is halted.

When the decision at step 106 is negative (NO), program control advances to step 107, and the internal tank pressure P1 and the differential value d(P1)/dt (referred to as a first differential value) are read and stored. At step 108, a check is performed to determine whether the first differential value d(P1)/dt is smaller than a first reference value=−1. When the absolute value of the first differential value is greater, it means that the pressure has been greatly changed over a short period of time, i.e., that there is a large a ripple. By employing this process, a check is performed that determines whether a large pneumatic tool connected to the air tank 10A is currently being employed for an operation that consumes a large amount of air in a short period of time. In this embodiment, −1 is set as the predetermined value.

When ripple, although large, occur less frequently, a great amount of air is not always consumed over a long period of time. Therefore, at step 109, ripples are counted and the count value is updated, and at step 110, a check is performed to determine whether the count value CNT1 is three or greater. When the decision at step 110 is affirmative (YES), program control is shifted to step 124. And when the decision at step 110 is negative (NO), at step 111, a check is performed to determine whether a predetermined period of time, i.e., five seconds, has elapsed. When the decision at step 111 is negative (NO), program control returns to step 106. That is, when three large ripples are detected before the predetermined period of time (five seconds) has elapsed, it is determined, based on the size of the ripples and their frequency, that a large pneumatic tool is currently being employed for an operation like continuous nail driving. Program control thereafter advances to step 124.

At step 124, the voltage (V) at the power source 310 for the power supply circuit 31 (FIG. 3) is detected by the voltage detector 311, and at step 125, a check is performed to determine whether the detected voltage is lower than a predetermined voltage. In this embodiment, the predetermined voltage is set as 90 V. That is, when a large amount of air is to be consumed by a pneumatic tool, it is preferable that the motor 33 immediately be rotated at a higher speed to increase the amount of compressed air that is generated. However, when another pneumatic tool is also connected to a power source connected to an air compressor and is being employed, the load imposed on the power source 310 will be increased and the breaker switch (not shown) of the power supply circuit 31 (FIG. 3) will be operated. Therefore, to avoid this phenomenon, at step 125, the value of the power supply voltage V is compared with the predetermined value (90 V), and when the decision at step 125 is affirmative (YES), i.e., when the power supply voltage V, which is generally 100 V, is equal to or lower than 90 V, it is assumed that another power tool is also being employed and that a considerable load is being imposed on the power source 310. Therefore, program control is shifted and the rotation speed N for the motor 33 is maintained at N2 (=2400 rpm).

When the voltage at the power source 310 is equal to or higher than 90 V, program control advances to step 126, where a load current I, flowing through the power supply circuit 31, is detected by the current detector 312. At step 127, a check is performed to determine whether the detected current I is greater than a predetermined value, which, in this embodiment, is 30 A. When the decision at step 127 is affirmative (YES), it is assumed that were the current rotation speed N of the motor 33 increased, the temperature T of the winding for the motor 33 would rise excessively, or the breaker switch of the power source 310 would be opened. In this case, program control is also shifted to step 131, and the rotation speed for the motor 33 is maintained at N2 (=2400 rpm).

When the decision at step 127 is negative (NO), program control advances to step 128, and the winding temperature T for the stator 331 of the motor 33 is measured. At step 129, a check is performed to determine whether the winding temperature T is higher than a predetermined temperature, which in this embodiment is 120° C. Further, although in this embodiment the temperature T of the winding for the motor 33 is measured, the temperature at another portion may be measured. When the temperature T of the motor winding is equal to or higher than 120° C., and the rotation speed of the motor 33 is further increased, the temperature T of the motor 33 will rise drastically and hinder the running of the motor 33. In addition, because of the excessive rise in the temperature T, considerable deterioration in the compressed air generation efficiency of the compressed air generator 20 will occur. Therefore, when the decision at step 129 is affirmative (YES), program control is also shifted to step 131, and the rotation speed N of the motor 33 is maintained as N2 (=2400 rpm). When the decision at step 129 is negative (NO), program control advances to step 130 and the rotation speed N of the motor 33 is set to N3 (=3600 rpm).

At step 132, a check is performed to determine whether the pressure P1 in the air tank 10A is greater than 30 kg/cm$^2$. When the decision at step 132 is affirmative (YES), program control returns to step 105 and the motor 33 is halted. When the decision at step 132 is negative (NO), at step 133, a check is performed to determine whether five seconds have elapsed. When the decision at step 133 is affirmative (YES), program control is shifted to step 102. Through the processes performed at steps 132 and 133, the same rotation speed is maintained for the motor 33 for five seconds because an uncomfortable sensation is provided when the rotation speed is frequently changed.

When the decision at step 110 is negative (NO), i.e., when the ratio of the pressure change in the air tank 10A for a short period is smaller than a predetermined value, program control advances to step 111 and a check is performed to determine whether five seconds have elapsed.

When the decision at step 111 is negative (NO), program control returns to step 106. And when the decision at step 111 is affirmative (YES), program control advances to step 112, and the differential value d(P2)/dt (referred to as a second differential value) for a pressure change signal P2, which is obtained by using the low-pass filter 47 to remove the ripples from the detection signal P1 through, is calculated and stored in the RAM 42.

Figure 6:
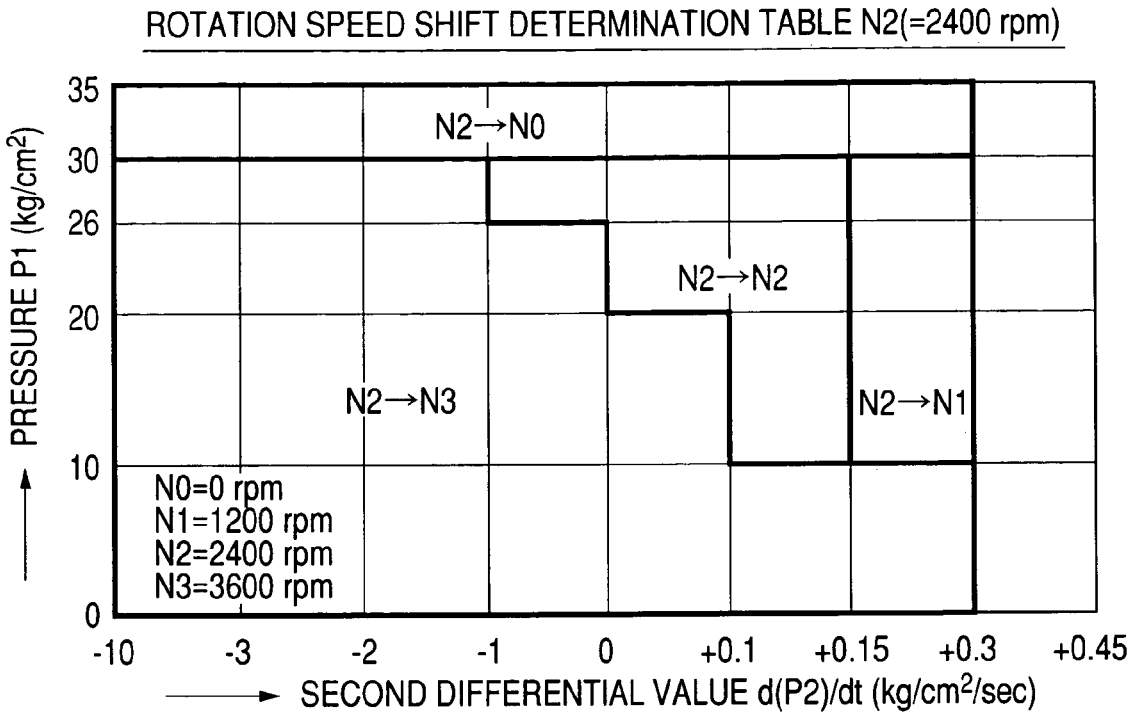
FIG. 6 is a diagram for explaining a rotation speed shift determination table used for controlling the air compressor according to the embodiment of the invention.
Figure 7:
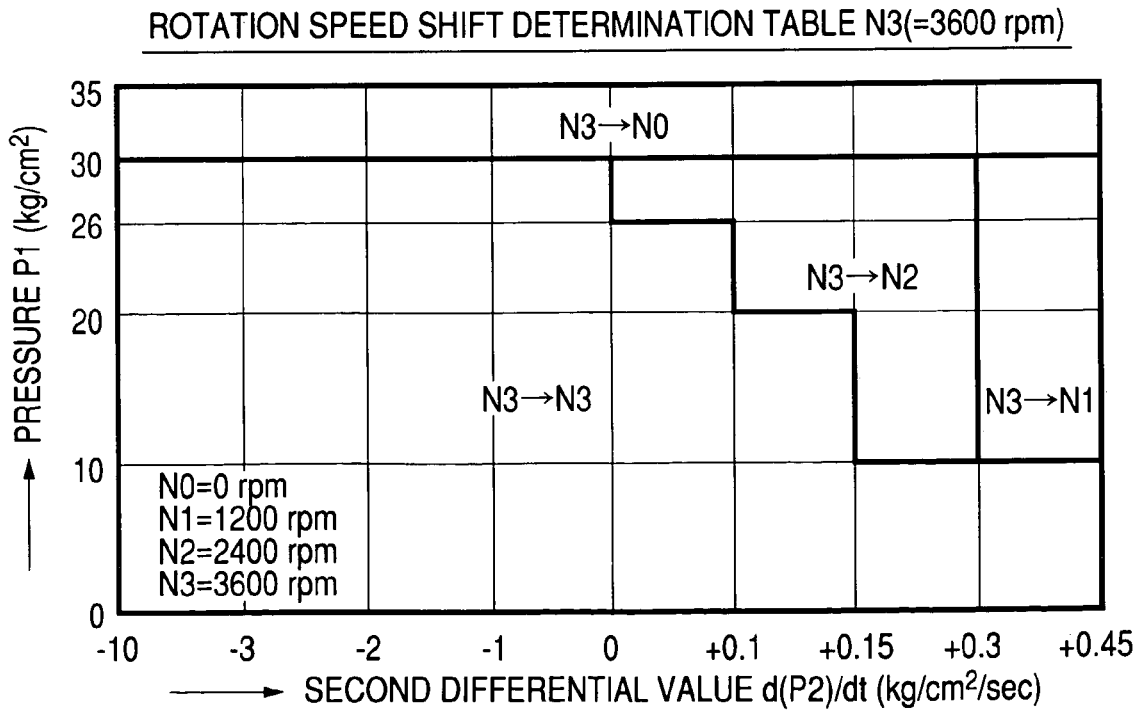
FIG. 7 is a diagram for explaining a rotation speed shift determination table used for controlling the air compressor according to the embodiment of the invention.
Figure 8:
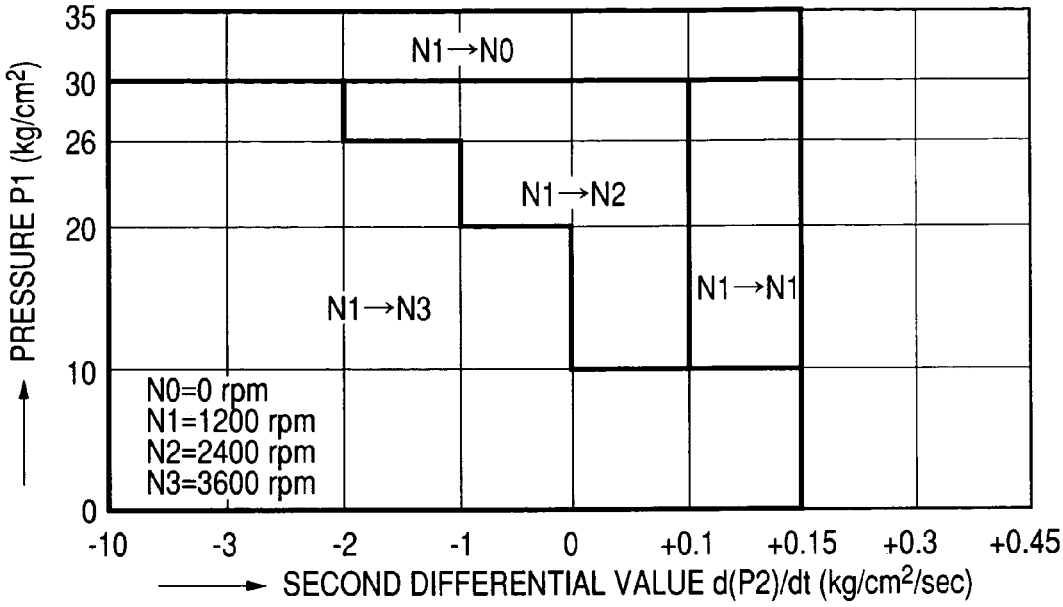
FIG. 8 is a diagram for explaining a rotation speed shift determination table used for controlling the air compressor according to the embodiment of the invention.
Figure 9:
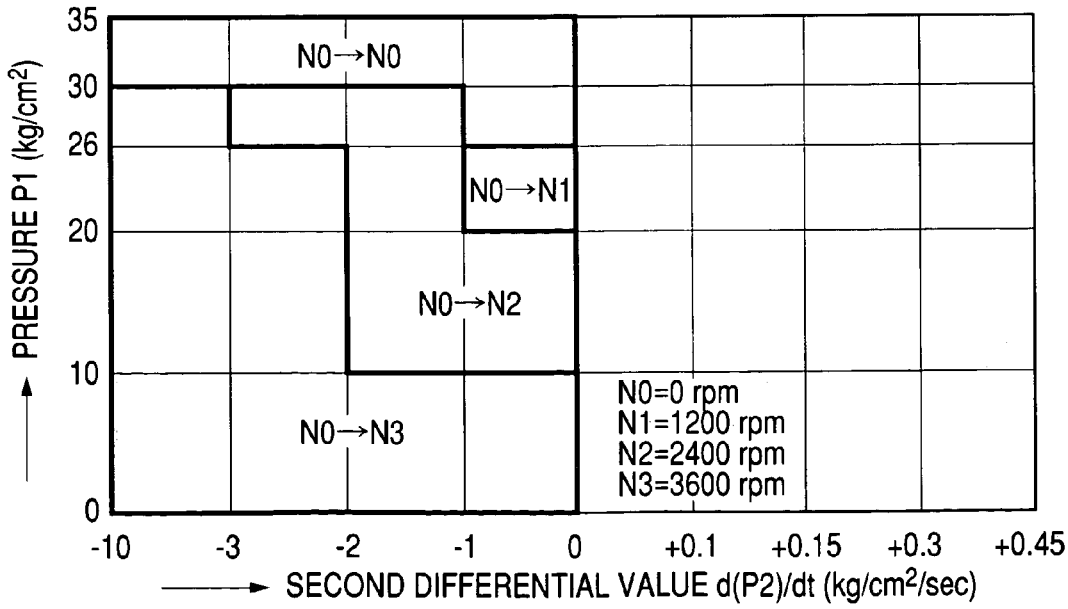
FIG. 9 is a diagram for explaining a rotation speed shift determination table used for controlling the air compressor according to the embodiment of the invention.

At step 113, a rotation speed shift determination table is selected. Four types of rotation speed shift determination tables, shown in FIGS. 6, 7, 8 and 9, are stored in advance in the RAM 42 of the controller portion 40. When the current rotation speed N of the motor 33 is the initial value N2 (=2400 rpm), the table in FIG. 6 is selected. When the current rotation speed N is N3 (=3600 rpm), the table in FIG. 7 is selected. Likewise, when the rotation speed N is N1 or N0, the table in FIG. 8 or the table in FIG. 9 is selected respectively. For these tables, the vertical axis represents the pressure P1 in the air tank 10A, while the horizontal axis represents the second differential value, d(P2)/dt, of the pressure change signal P2 obtained by removing the ripple of the pressure P1 in the air tank 10A. Based on these values, the rotation speed of the motor 33 is determined.

Referring to FIG. 6, when the internal tank pressure P exceeds 30 kg/cm$^2$, the rotation speed N0 is set, regardless of the second differential value of d(P2)/dt, i.e., the motor 33 is halted. This is a natural process because the internal tank pressure is constantly maintained within a range of 26 to 30 kg/cm$^2$.

When the second differential value d(P2)/dt is negative, it means that the consumption of compressed air exceeds the supply of compressed air to the air tank 10A, and the current rotation speed N2 (=2400 rpm) of the motor 33 is changed to the higher rotation speed N3 (=3600 rpm). Especially when the pneumatic tools 51 and 52 (FIG. 1) are in full operation, the consumption of compressed air is increased and the pressure in the air tank 10A drops rapidly. In this embodiment, therefore, the rotation speed is immediately changed to N3 when the second differential value d(P2)/dt is −1 kg/cm$^2$/sec or smaller and the internal tank pressure P1 is 30 kg/cm$^2$ or lower. When the second differential value d(P2)/dt is comparatively small, e.g., 0 to −1 kg/cm$^2$/sec, and when the pressure P in the air tank 10A is 26 kg/cm$^2$ or higher, the motor 33 continues to be rotated at the rotation speed N2, and is changed to N3 only when the pressure P1 in the air tank 10A is less than 26 kg/cm$^2$. Furthermore, when the second differential value d(P2)/dt is in a range of 0 to +0.1 kg/cm$^2$/sec, i.e., when the supply of compressed air slightly exceeds the consumption of compressed air and when the pressure P1 in the air tank 10A is 20 kg/cm$^2$ or greater, the motor 3 continues to be driven at N2, and is changed to N3 only when the pressure P is less than 20 kg/cm$^2$.

When the second differential value d(P2)/dt is within the range +0.1 to +0.15 kg/cm$^2$/sec, it means that the amount of compressed air in the air tank 10A is gradually increasing. Thus, when the internal tank pressure P is 10 kg/cm$^2$ or greater, the motor 33 continues to be rotated at N2, and then, is changed to N3 when the pressure P drops below 10 kg/cm$^2$. When the second differential value d(P2)/dt is increased to +0.15 to +0.3 kg/cm$^2$/sec, it is predicted that the internal tank pressure P is rapidly increasing. Therefore, when the pressure P in the air tank 10A is 10 kg/cm$^2$ or greater, the rotation speed of the motor 33 is lowered from the current level N2 to N1.

In this explanation, the rotation speed N2 at which the motor 33 is currently running is changed to N0, N3 and N1. When the current rotation speed is N3, N1 or N0, the speed is shifted in accordance with different patterns shown in FIG. 7, 8 or 9.

Referring again to FIG. 4, at step 114, based on the detection signal P1 for the internal tank pressure and the second differential value, i.e., the differential value d(P2)/dt for the pressure change signal P2, which is obtained by removing the ripples from the detection signal P1, the next rotation speed for the motor 33 is determined by searching in the selected table. Then, at step 115, a check is performed to determine whether the selected rotation speed N is N3 (=3600 rpm). When the decision at step 115 is affirmative (YES), instead of immediately changing the rotation speed to N3, a check is performed at steps 116 to 121 to determine whether the power supply voltage V is 90 V or higher, the load current I is 30 A or lower, and the motor winding temperature T is 120° C. or lower. Since the processes at steps 116 to 121 are the same as those at steps 124 to 129, no further explanation will be given. Through these processes, the activation of the breaker switch (not shown) and a rapid rise in the temperature T of the motor 33 are prevented.

When it is ascertained at steps 116 to 121 that the breaker switch will not be opened and the temperature T of the motor 33 will not be raised excessively when the rotation speed N of the motor 33 is changed to the maximum speed of 3600 rpm, program control advances to step 122 and the motor speed is set to N=N3 (=3600 rpm). When the condition at step 117, 119 or 121 is not satisfied, program control is shifted to step 123 and the rotation speed N of the motor 33 is maintained at N2.

That is, in this invention, when the negative value of the first differential valued (P1)/dt is large and the occurrence frequency is high, or when the negative value of the second differential value d(P2)/dt is large, it is predicted that the consumption of compressed air will be increased, and the rotation speed N of the motor 33 is increased until it reaches the higher level rotation speed N3. However, when a large load has already been imposed on the motor 33, and this causes the breaker switch to open or produces an excessive rise in the temperature T of the motor winding, the rotation speed N2 is maintained as the rotation speed N of the motor 33.

The operation of the air compressor of the invention will now be described while referring to FIGS. 5A, 5B, 5C and 5D.

Figure 5A:
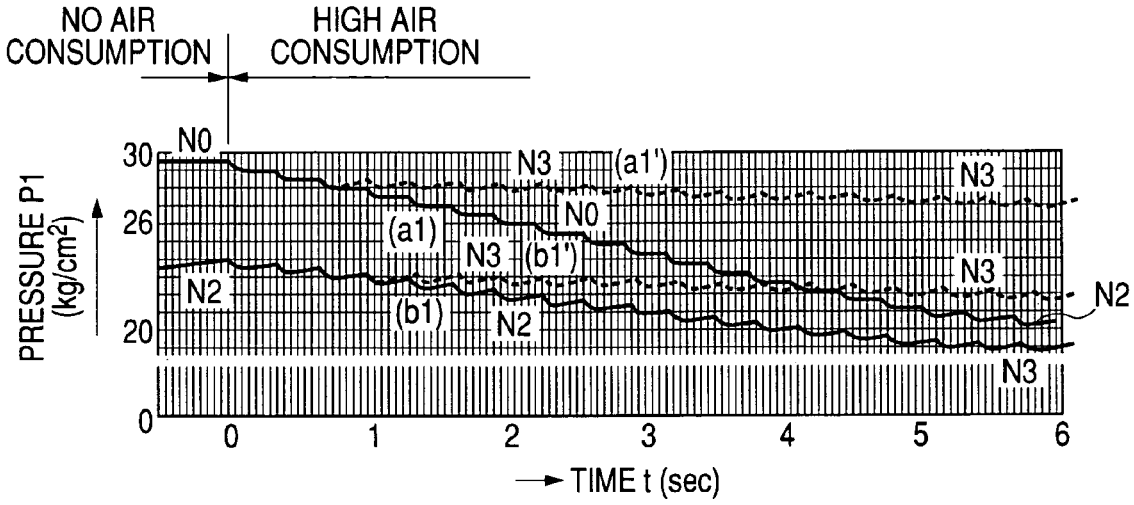
FIG. 5A is a pressure change curve graph for explaining the operation of the air compressor according to the embodiment of the invention.

In FIG. 5A, the horizontal axis represents time and the vertical axis represents the pressure P1 of the compressed air in the air tank 10A. Curves (a1) and (b1) represent a case wherein a ripple in the pressure in the air tank 10A is not detected three times within five seconds, i.e., a case wherein the rotation speed of the motor is controlled in accordance with a pressure change occurring over an extended period of time, but not in accordance with frequent pressure changes occurring within a short period of time. Curves (a1') and (b1') represent a case wherein ripple detection is performed for the pressure in the air tank 10A; the rotation speed of the motor is increased when a large ripple is detected three times within five seconds.

Figure 5B:
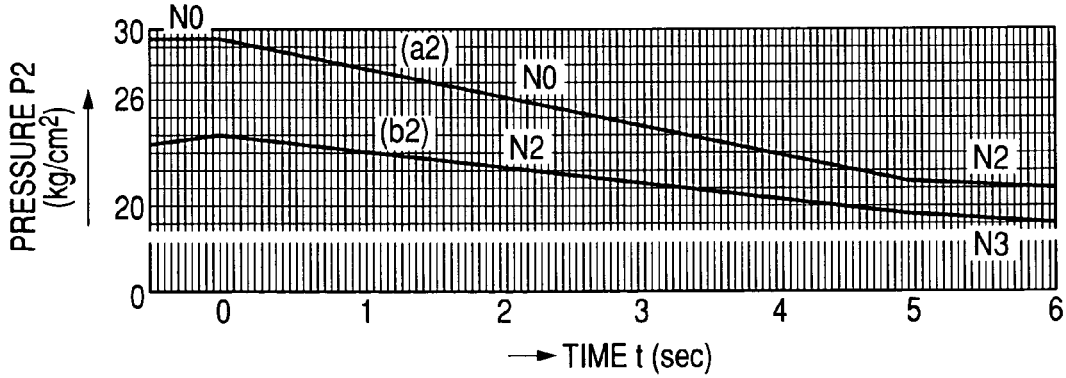
FIG. 5B is a pressure change curve graph for explaining the operation of the air compressor according to the embodiment of the invention.

In FIG. 5B, the horizontal axis represents time, and the vertical axis represents the pressure change signal P2 obtained by using the low-pass filter 47 to remove wave ripples from the pressure detection signal P1. Curves (a2) and (b2) correspond to the curves (a1) and (b1) in FIG. 5A.

Figure 5C:
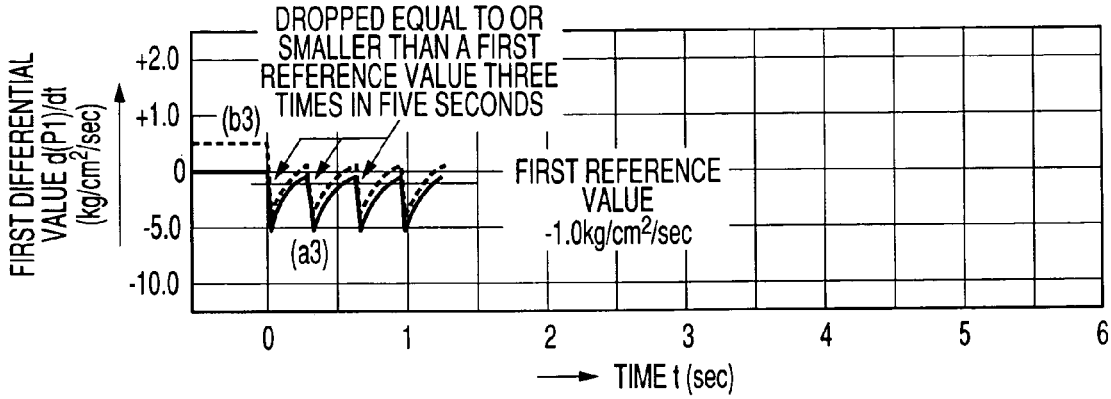
FIG. 5C is a pressure change curve graph for explaining the operation of the air compressor according to the embodiment of the invention.

In FIG. 5C, the horizontal axis represents time and the vertical axis represents a time differential value d(p1)/dt (first differential value) for the pressure signal P1 in FIG. 5A. Curves (a3) and (b3) correspond to the curves (a1) and (b1) in FIG. 5A.

Figure 5D:
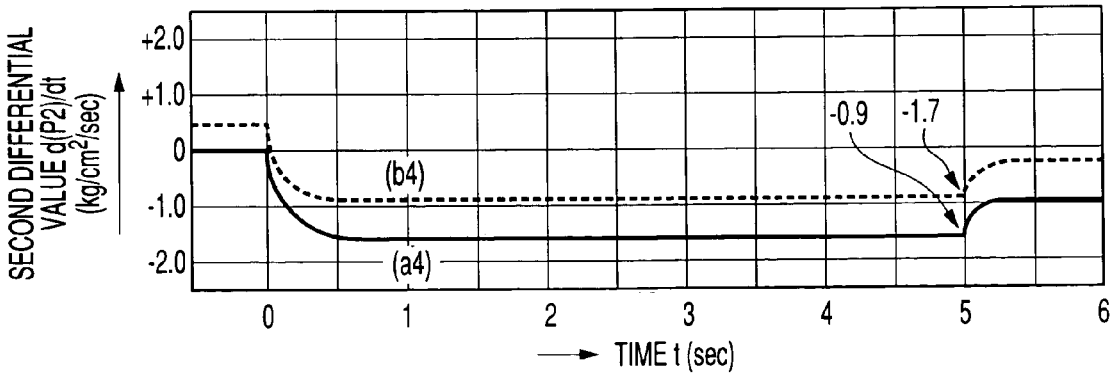
FIG. 5D is a pressure change curve graph for explaining the operation of the air compressor according to the embodiment of the invention.

In FIG. 5D, the horizontal axis represents time and the vertical axis represents a time differential value d(P2)/dt (second differential value) for the pressure signal P2 in FIG. 5B. Curves (a4) and (b4) correspond to the curves (a2) and (b2) in FIG. 5B.

According to the curve (a1), up to time t=0, the pressure P1 in the air tank 10A is 29 kg/cm$^2$, compressed air is not being consumed, and the motor 33 is halted. When continuous nail driving using a nailer, for example, is started at time t=0, a large amount of air is consumed, and the internal tank pressure pulsates and drops sharply. After t=five seconds has elapsed, the second differential value, i.e., d(P2)/dt, is read. Since this value d(P2)/dt is −1.7 in FIG. 5D, the intermediate rotation speed N2=2400 rpm is selected from the rotation speed shift determination table (FIG. 9). Therefore, from t=0 second to t=5 seconds, the motor 33 is rotated at N0, and after t=5 seconds, it is rotated at N2.

In FIG. 5A, the curve (a1') represents a case wherein ripple detection is performed. Up to time t=0, the internal tank pressure P is 29 kg/cm$^2$, and the motor 33 is halted. When continuous nail driving is begun at time t=0, as well as for the curve (a1), the internal tank pressure P pulsates and is reduced. However, while referring to FIG. 5C, since the first differential value d(P1)/dt has equaled or has been smaller than the first reference value 1=−1.0 kg/cm$^2$/sec three times within five seconds, it is determined that the air consumption is high. Furthermore, since the power supply voltage V is 90 V or higher, the load current I is 30 A or smaller and the motor winding temperature T is 120° C. or lower, the motor 33 is immediately shifted to the high rotation speed N3=3600 rpm. Therefore, after the first differential value d(P1)/dt has equaled or been smaller than the first reference value three times in five seconds, the motor 33 is rotated at the high rotation speed N3, 3600 rpm, so that in the air tank 10A, as indicated by the curve (a1'), the reduction in the pressure P suppressed, and a pressure of close to 29 kg/cm$^2$is maintained.

According to the curve (b1) in FIG. 5A, up to time t=0, the pressure P1 in the air tank 10A is 26 kg/cm$^2$ or smaller, the compressed air is not consumed, and the motor 33 is rotated at the intermediate rotation speed N2=2400 rpm. At this time, the pressure P1 is gradually increased. Then, when continuous nail driving is started at t=0, the pressure P1 in the air tank 10A pulsates and is reduced. After five seconds have elapsed, the second differential value d(p2)/dt is read, and since this value d(P2)/dt is −0.9, as is shown in FIG. 5D, N3=3600 rpm is selected from the rotation speed shift determination table (FIG. 6). Therefore, up to t=5 seconds, the motor 33 is rotated at intermediate rotation speed N2=2400 rpm, but thereafter, its rotation speed is changed and it is rotated at the high rotation speed N3, 3600 rpm. However, during the five second period, the pressure P1 in the air tank 10A is considerably reduced.

According to the curve (b1'), as well as the curve (b1), up to time t=0, the pressure P in the air tank 10A is 26 kg/cm$^2$ or smaller, compressed air is not consumed, and the motor 33 is rotated at the intermediate rotation speed N2=2400 rpm. When continuous nail driving has been started at t=0, as also shown by the curve (b1), the pressure P in the air tank 10A pulsates and is reduced. However, while referring to FIG. 5C, since the first differential value d(P1)/dt has equaled or has been smaller than the first reference value=−1.0 kg/cm$^2$/sec three times within five seconds, it is determined that the air consumption is high. Furthermore, since the power supply voltage V is 90 V or higher, the load current I is 30 A or smaller and the motor winding temperature T is 120° C. or lower, after d(P1)/dt has equaled or has been smaller than the first reference value three times in five seconds, the motor 33 is shifted immediately to the high rotation speed N3=3600 rpm. Therefore, compared with the case illustrated by the curve (b1), in the air tank 10A, the reduction in the pressure P1 in the air tank 10A can be suppressed, and substantially the same pressure level as at t=0 can be maintained after the continuous nail driving is started.

The preferred embodiment of the present invention has been described; however, the present invention can be variously and easily modified without changing the basic idea of the invention, and these modifications are also included in the scope of the invention. For example, in the embodiment, the motor is shifted to a high rotation speed when the first differential value d(P1)/dt for the detection signal P1 of the pressure in the air tank 10A has equaled or has been smaller than the predetermined reference value (−1.0 kg/cm$^2$/sec) three times in five seconds. However, the time values five seconds, three times and (−1.0 kg/cm$^2$/sec) are merely examples, and different ones can be employed as needed. Further, the present invention can also be easily modified so that these values are changed to arbitrary values, rather than fixed.

The air compressor of the present invention is mainly employed for pneumatic tools such as pneumatic nailers.

What is claimed is:

1. An air compressor comprising:

a tank unit storing a compressed air used by a pneumatic tool;

a compressed air generator which generates the compressed air and supplies the compressed air to the tank unit;

a motor driving the compressed air generator;

a drive portion including the motor;

a controller portion controlling the drive portion; and a pressure sensor detecting an air pressure of the compressed air in the tank unit, wherein the controller portion controls a rotation speed of the motor at multiple levels based on a detection signal P1 of the pressure sensor, a first differential signal which is a differential value d(P1)/dt of the detection signal P1, and a second differential signal which is a differential value d(P2)/dt of a detection signal P2 obtained by removing a pulsatory element from the detection signal P1.

2. The air compressor according to claim 1, further comprising:

a temperature sensor detecting a temperature of the motor, wherein the controller portion controls the rotation speed of the motor at multiple levels in accordance with a detection signal of the temperature sensor, the detection signal P1 of the pressure sensor and the first and the second differential signals.

3. The air compressor according to claim 1, further comprising:

a sensor detecting a power voltage and a load current of the drive portion, wherein the controller portion controls the rotation speed of the motor in accordance with a detection signal of the sensor which detects the power voltage and the load current of the drive portion, the detection signal P1 of the pressure sensor and the first and the second differential signals.

4. An air compressor comprising:

a tank unit storing a compressed air used by a pneumatic tool;

a compressed air generator which generates the compressed air and supplies the compressed air to the tank unit;

a motor driving the compressed air generator;

a drive portion including the motor;

a controller portion controlling the drive portion; and a pressure sensor detecting an air pressure of the compressed air in the tank unit, wherein the controller portion controls a rotation speed of the motor at multiple levels based on a detection signal P1 of the pressure sensor, a first differential signal which is a differential value d(P1)/dt of the detection signal P1, and a second differential signal obtained by supplying the first differential signal to a low-pass filter.

5. The air compressor according to claim 4, further comprising:

a temperature sensor detecting a temperature of the motor, wherein the controller portion controls the rotation speed of the motor at multiple levels in accordance with a detection signal of the temperature sensor, the detection signal P1 of the pressure sensor and the first and the second differential signals.

6. The air compressor according to claim 4, further comprising: a sensor detecting a power voltage and a load current of the drive portion, wherein the controller portion controls the rotation speed of the motor in accordance with a detection signal of the sensor which detects the power voltage and the load current of the drive portion, the detection signal P1 of the pressure sensor and the first and the second differential signals.

7. A control method for an air compressor that includes a tank unit storing an compressed air used by a pneumatic tool, a compressed air generator which generates the compressed air and supplies the compressed air to the tank unit, a motor driving the compressed air generator, a drive portion including the motor, and a controller portion controlling the drive portion, the control method comprising:

detecting a compressed air pressure P1 in the tank unit;

detecting a differential signal d(P1)/dt of the pressure P1;

detecting a differential signal d(P2)/dt of a pressure change signal P2 from which a pulsatory element of the pressure P1 is removed; and controlling a rotation speed of the motor at multiple levels in accordance with the compressed air pressure P1 and the differential signals d(P1)/dt and d(P2)/dt.

8. The control method according to claim 7, further comprising:

counting not less than a predetermined number of pulsations that occur during a predetermined period of time, wherein, the rotation speed of the motor is controlled when a count value is equal to or greater than the predetermined number of pulsations.

9. The control method according to claim 7, further comprising:

detecting a motor temperature T; and controlling the rotation speed of the motor at multiple levels in accordance with the pressure P1, the differential signals d(P1)/dt and d(P2)/dt, and a detection signal of the motor temperature T.

10. The control method according to claim 7, further comprising:

detecting a power voltage V and a load current I of the drive portion; and controlling the rotation speed of the motor at multiple levels in accordance with the power voltage V and the load current I, the pressure P1 and the differential signals d(P1)/dt and d(P2)/dt.

* * * * *